US006353971B1

(12) United States Patent
Krawczyk

(10) Patent No.: US 6,353,971 B1
(45) Date of Patent: Mar. 12, 2002

(54) TOUCHLESS DOOR PULL APPARATUS

(75) Inventor: Jeffrey Robert Krawczyk, Appleton, WI (US)

(73) Assignee: Sanikey, LLC, Hortonville, WI (US)

( * ) Notice: Subject to any disclaimer, the term of this patent is extended or adjusted under 35 U.S.C. 154(b) by 0 days.

(21) Appl. No.: 09/535,694

(22) Filed: Mar. 27, 2000

Related U.S. Application Data

(60) Provisional application No. 60/181,745, filed on Feb. 11, 2000.

(51) Int. Cl.[7] ..... E05B 1/00; E05B 5/00; A45C 13/26

(52) U.S. Cl. ..... 16/412; 16/413; 16/415; 16/110.1; 16/904

(58) Field of Search ..... 16/904, 412, 413, 16/415, 110.1; 292/DIG. 8, DIG. 12, 347, 1; 70/389

(56) References Cited

U.S. PATENT DOCUMENTS

| | | | | |
|---|---|---|---|---|
| 148,893 A | | 3/1874 | McClellan | |
| 608,592 A | * | 8/1898 | Girrens et al. | 70/389 |
| 1,337,918 A | * | 4/1920 | Kennington | 16/412 |
| 4,153,314 A | | 5/1979 | Prater | 312/320 |
| 4,583,383 A | | 4/1986 | Bosco et al. | 70/408 |
| 4,658,469 A | | 4/1987 | Hawkins | 16/110 R |
| 4,686,742 A | | 8/1987 | Arnold | 16/112 |
| 4,710,634 A | | 12/1987 | Brookes | 250/455.1 |
| 4,817,239 A | | 4/1989 | Campbell et al. | 16/114 R |
| 4,850,062 A | | 7/1989 | Gibson et al. | 4/251 |
| 4,856,140 A | | 8/1989 | Visco et al. | 16/114 R |
| 5,220,693 A | | 6/1993 | Paglia | 4/246.1 |
| 5,231,733 A | * | 8/1993 | Dittman | 16/413 |
| 5,307,528 A | | 5/1994 | Nieuwenhuis et al. | 4/576.1 |
| 5,341,519 A | | 8/1994 | Cusenza | 4/246.1 |
| 5,511,284 A | | 4/1996 | Current | 16/82 |
| 5,621,936 A | | 4/1997 | Penaligon et al. | 7/151 |
| 5,638,576 A | * | 6/1997 | Mutone | 16/413 |
| 5,737,951 A | | 4/1998 | Krass | 70/456 R |
| 5,794,471 A | | 8/1998 | Rizzo | 70/456 R |
| 5,924,750 A | | 7/1999 | Fuss et al. | 292/201 |
| 5,983,454 A | | 11/1999 | Hartselle, III | 16/412 |
| 6,092,849 A | * | 7/2000 | Zambelli et al. | 294/89 |

* cited by examiner

*Primary Examiner*—Chuck Y. Mah
(74) *Attorney, Agent, or Firm*—Wilhelm Law Service; Thomas D. Wilhelm

(57) ABSTRACT

Touchless door pull apparatus comprising an engagement slot on a door, and a cooperating hand tool. The slot and hand tool are cooperatively configured such that the hand tool can be engaged with an engagement surface associated with the slot, temporarily coupling the hand tool and the door to each other. The hand tool is then pulled away from the door, thus to open the door without touching the door. The slot can be part of a door accessory mounted on the door, or can be fabricated into the door structure. As an accessory, the door pull apparatus comprises a pull base for mounting on the door. The pull base and hand tool have first and second engagement elements, cooperatively configured such that the first and second engagement elements can be engaged, thus to temporarily couple the hand tool and the pull base to each other. The first engagement surface is between the front and the rear of the pull base or door, in a cavity behind, and optionally laterally displaced to a first side of, or to opposing sides of, the slot or other engagement opening. The invention further comprehends methods employing the slot or opening, and the hand tool for pulling open a door without touching the door. The method preferably includes uncoupling and removing the hand tool from the door before door reclosure.

37 Claims, 4 Drawing Sheets

TOUCHLESS DOOR PULL APPARATUS

CROSS-REFERENCE TO RELATED APPLICATIONS

This application claims priority to Provisional Application Serial No. 60/181,745 filed Feb. 11, 2000.

FIELD OF THE INVENTION

This invention relates to sanitation in public restroom facilities, and specifically to improvements which enable users of such restroom facilities to avoid touching anything in the restroom after washing their hands.

BACKGROUND

Public restroom facilities are typically available to a wide variety of people who have been exposed to a correspondingly wide variety of environments, and wherein such people may have picked up toxins or pathogenic disease organisms, collectively referred to herein as "contaminants," in such environments. When such people use public restroom facilities, and correspondingly come into physical contact with certain surfaces in the restroom, such as for example and without limitation water closets and their controls, sinks, water faucets, paper dispensers, soap dispensers, and the like, there is a risk that such contaminants may transfer from the respective user to such surfaces, thus contaminating the respective surfaces.

Such contaminants can remain viable for a substantial time after being so deposited such that a subsequent user may touch the respective surface and pick up the still viable contaminants, and may thereafter become afflicted with a disease or other harmful medical condition associated with such contaminants.

As used herein, "public restroom facilities" means any restroom facility that is available to a group of users who do not otherwise personally reside together as a family unit. Such groups and environments include, for example and without limitation, places of employment, tourist and recreation facilities, government offices, facilities occupied by religious or other charitable organizations, military facilities, restaurants, and stores.

In order to reduce the incidence of harmful medical conditions associated with public restroom facilities, it has become common practice to regularly clean and disinfect such restroom facilities thereby to limit and control the amount of such contaminants which may be present in such public restroom facilities at any given time, based on the theory that reduced quantities of contaminants in the restroom results in less contaminant pick-up by users, and corresponding lower incidence of harmful medical effect. But however good such cleaning may be, the next user may again deposit such unwanted contaminants, which can then be picked up by subsequent users.

Thus, in order to effectively maintain strict sanitation of a restroom facility by way of maintaining the restroom in a clean condition, namely regularly removing contaminants which have been deposited, the restroom facility can only be used by one user at a time; and the restroom facility must be cleaned after each use, to remove whatever contaminants, if any, may have been deposited by that user. In addition, if strict sanitation is to be maintained, the cleaning process, itself, must be completely sanitary, such that the person doing the cleaning does not introduce contaminants during the cleaning of the restroom.

In any event, except for highly specialized uses, such high level of maintenance effort is prohibitively costly. Thus, while significant improvement has been made in sanitation of public restroom facilities by implementation of cleaning procedures, there is a practical limit to the degree to which spread of contaminants can be controlled by cleaning procedures in public restrooms, as the fact that such facilities are repeatedly used by users introduces a repeated influx of unwanted contaminants into the respective restroom facilities.

Further improvement in controlling spread of such contaminants, beyond cleaning steps, has been made by providing apparatus and structure in such restroom facilities which discourages users from coming into direct contact with surfaces which may have been contacted, and therefore contaminated, by previous users. In addition, such apparatus and structure also reduces the amount of contaminants deposited. Thus, supplies and equipment have been introduced whereby a user can choose to touch a minimum number of surfaces which may have been contaminated by previous users. For example and without limitation, water closets may be fitted with proximity sensors which sense the user approaching, and subsequently leaving, proximity of the water closet thereby to automatically flush the water closet. Water faucets may be correspondingly fitted with proximity sensors. Paper towels and air dryers may be provided for drying a user's hands after washing.

While a variety of improvements have thus been made in preserving cleanliness of the restroom facility, and while a variety of supplies and machines have been provided for cleansing a user's hands after use of e.g. water closet appliances, and avoiding touching surfaces in the restroom after the user's hands have been cleansed, there remains one barrier between the newly-cleansed user and the outside world, namely the door to the restroom.

In most cases, a hinged door is used to close off visual access to the interior of the restroom. Such door typically swings into the restroom, and thus comprises a physical barrier to the user exiting the room. As each person leaves the restroom, he/she grasps a door handle or the like, and pulls the door open. In the process of so opening the door, he/she may deposit on the door handle any contaminants which may remain on his/her hands or any contaminants picked up in the restroom. In addition, he/she may pick up contaminants deposited on the door handle by a previous user. Thus, there remains the problem of contaminant transfer at the restroom door, typically through use of the door handle as the user exits the room.

As one solution to the problem of contamination at the door, such contamination and/or transfer of contaminants can be virtually eliminated by door construction. For example and without limitation, where enough space is available, the doorway can be designed and built so as to provide a turn in the entryway, so as to leave the doorway open but so oriented as to block visual access into the room from outside the room. In an alternate design, the door itself may be opened by an electric or other power device, automatically activated by a proximity or other sensor whereby the user need not touch the door in order for the door to open. However, as a practical matter, there remain a large number of doorways, existing and likely to be constructed in the future, which are in fact closed by a hinged door in the doorway, which door is opened by manual effort of the person exiting the restroom.

Thus, there is a need for efficient structure associated with manuallyoperated doors whereby a user can easily open the door without, in the process, risking the possibility of receiving contaminants from the door or risking depositing contaminants on the door.

It is thus an object of this invention to provide touchless door pull apparatus cooperatively configured such that a user can employ a hand tool, either a tool carried by the user or a sanitary hand tool acquired by the user in or proximate the restroom, to engage and manually pull open the door.

It is another object to provide on the door secondary door opening apparatus, optionally in addition to the regular door handle, whereby the user can manually open the door without touching the door.

It is yet another object to provide touchless door pull apparatus wherein a user engages a hand tool in a slot or other opening in the door, optionally in a pull base mounted on the door, thereby engaging an engagement element on the door with a cooperating engagement element on the hand tool, thus to pull open the door.

It is still another object to provide methods of manually pulling open a door by inserting a hand tool into an engagement opening in the door, engaging engagement structure on the hand tool with engagement structure associated with the opening, and pulling on the hand tool thereby to pull open the door.

SUMMARY OF THE DISCLOSURE

The invention generally contemplates touchless door pull apparatus comprising an engagement slot on a door, and a cooperating hand tool. The engagement slot and the hand tool comprise first and second engagement elements cooperatively configured such that the second engagement element on the hand tool can be engaged with the respective first engagement element on the door, thus to temporarily couple the hand tool and the door to each other. The hand tool and the door remain coupled when the hand tool is pulled away from the door, whereby a user can pull on the so coupled hand tool and thereby open the door without touching the door.

The engagement slot can be structured in a door accessory which is mounted on the door, such as in a retro-fit application to an existing door. In the alternative, such accessory can be mounted on a newly-constructed door. Further, the engagement slot can be fabricated into, namely as part of, an element of the door structure.

More specifically, in a first family of embodiments, the invention comprehends touchless door pull apparatus, comprising a pull base for mounting on a door, in combination with a hand tool. The pull base comprises a first engagement element, which is ineffective as a pull handle for grasping with a hand of a user. The hand tool comprises a grasping end for being grasped by the user, and an engagement end. The engagement end comprises a second engagement element. The pull base and the hand tool, including the first and second engagement elements, are cooperatively configured such that the second engagement element on the hand tool can be engaged with the first engagement element on the pull base, thus to temporarily couple the hand tool and the pull base to each other, such that the hand tool can be pulled in a direction away from the pull base while the hand tool and the pull base remain temporarily coupled to each other. Thus, when the pull base is in secure association on a hinged door, away from an edge of the door bearing the hinges, the user can pull on the hand tool and thereby pull open the door without touching the door or the pull base.

In some embodiments, the pull base further comprises a rear, a front, an engagement slot associated with the front, and a first engagement portion defined in the first engagement element. The first engagement portion is disposed between the front and the rear, is associated with the engagement slot, and facilitates coupling the hand tool to the pull base. The hand tool further comprises a second engagement portion defined in the second engagement element.

In some embodiments, the rear of the pull base defines mounting structure, optionally a mounting surface, which facilitates mounting the pull base to a face of the door at a location displaced substantially from the hinge mounting edge of the door.

In some embodiments, the front of the pull base comprises first and second adjacent and cooperating front elements defining the slot therebetween, and the first engagement element is associated with the slot at at least one of the first and second front elements.

In some embodiments, the rear of the pull base defines an optionally imaginary surface corresponding to a surface of a door to which the touchless door pull apparatus is compatible with being mounted, the first engagement element having a first engagement surface thereof oriented transverse to, optionally perpendicular to, a line which line is perpendicular to such optionally imaginary surface.

In some but not all embodiments, the engagement slot extends from a top of the pull base to a bottom of the pull base.

In some preferred embodiments, the engagement slot at a first segment thereof is sufficiently wide to receive the second engagement portion of the hand tool behind the front of the pull base such that the second engagement element is between the first engagement element and the rear of the pull base, the engagement slot being relatively narrower at a second segment thereof so as to prevent lateral movement of the second engagement element from uncoupling the second engagement element from the first engagement element, the second engagement portion of the hand tool preferably being sized and configured to cooperatively engage the first engagement portion of the pull base at the second segment of the slot.

In some embodiments, the hand tool comprises a shaft having a first width, the slot defining a second width between opposing first and second frontwardly disposed sides thereof at the first engagement element, and a third greater width between third and fourth sides thereof disposed rearwardly of the first and second sides. The combination of the first, second, third, and fourth sides defines a portion of the slot at the second segment thereof wherein the third width is greater than the first width, the slot portion being geometrically compatible with receiving and concurrently engaging opposing portions of the second engagement element.

Preferably, the first engagement portion is located in a central portion of the pull base.

In some embodiments, the front defines a front surface of the pull base, the rear defines a rear surface of the pull base. The first engagement portion defines a first engagement surface extending transversely along a length of the slot rearwardly of the front surface and frontwardly of the rear surface.

In some embodiments, the pull base further comprises a rear, a front including a front surface, and an engagement opening extending through the front surface. The engagement opening is sized and configured to receive the second engagement element. A cavity is disposed rearwardly of, and laterally displaced to a first side of, optionally on opposing sides of, the engagement opening whereby the engagement end of the hand tool can be inserted into the engagement opening and laterally displaced toward engaging relationship with the first engagement element, optionally rotated toward engaging relationship with the first engagement element.

The engagement slot can extend from a relatively upwardly disposed location to a relatively downwardly disposed location.

In a second family of embodiments, the engagement slot is fabricated in the door such that the touchless door pull apparatus comprises a door having a hinged edge thereof, a door pull effective as a pull device for grasping with a hand of a user and opening the door, and a first engagement element ineffective as a pull device for grasping with the hand of the user and opening the door, the first engagement element being disposed away from the hinged edge of the door; and a hand tool comprising a grasping end for being grasped by the user, and an engagement end comprising a second engagement element. The pull base and the hand tool, including the first and second engagement elements, are cooperatively configured such that the second engagement element on the hand tool can be engaged with the first engagement element on the door, thus to temporarily couple the hand tool and the door to each other, such that the hand tool can be pulled in a direction away from the door while the hand tool and the door remain temporarily coupled to each other and such that the user can thereby pull on the hand tool and pull open the door without touching the door.

In some embodiments, the door further comprises a rear, a front, an engagement slot associated with the front, and a first engagement portion defined in the first engagement element. The first engagement portion is disposed between the front and the rear, is associated with the engagement slot, and facilitates coupling the hand tool to the door. The hand tool further comprises a second engagement portion defining the second engagement element.

In some embodiments, the front comprises first and second adjacent and cooperating front elements defining the slot therebetween, and the first engagement element is associated with the slot at at least one of the first and second front elements.

The engagement slot can extend from a relatively upwardly disposed location to a relatively downwardly disposed location.

In some embodiments, the engagement slot at a first segment thereof is sufficiently wide to receive the second engagement portion of the hand tool behind the front of the slot such that the second engagement element is between the first engagement element and the rear of the door, the engagement slot being relatively narrower at a second segment thereof so as to prevent lateral movement of the second engagement element from uncoupling the second engagement element from the first engagement element, the second engagement portion of the hand tool preferably being sized and configured to cooperatively engage the first engagement portion of the door at the second segment.

In some embodiments, the front defines a front surface of the door, the rear defines a rear surface of the door. The first engagement portion defines a first engagement surface extending transversely along a length of the slot rearwardly of the front surface and frontwardly of the rear surface.

In some embodiments, the hand tool comprises a shaft having a first width, the slot defining a second width between opposing first and second frontwardly-disposed sides thereof at the first engagement element, and a third greater width between third and fourth sides thereof disposed rearwardly of the first and second sides. The combination of the first, second, third, and fourth sides defines a portion of the slot at the second segment thereof wherein the third width is greater than the first width, the slot portion being geometrically compatible with receiving and concurrently engaging opposing portions of the second engagement element.

In some embodiments, the door further comprises a rear, a front including a front surface, and an engagement opening extending through the front surface. The engagement opening is sized and configured to receive the second engagement element. A cavity is disposed rearwardly, and laterally displaced to a first side of, optionally on opposing sides of, the engagement opening whereby the engagement end of the hand tool can be inserted into the engagement opening and laterally displaced toward engaging relationship with the first engagement element, optionally rotated toward engaging relationship with the first engagement element.

The invention further comprehends methods by which a person can pull open a door mounted on hinges, without such person touching the door. The method comprises defining on the door an engagement opening therein, the engagement opening comprising a rearwardly-facing first engagement surface associated with the engagement opening, the engagement opening being disposed away from a hinge-bearing edge of such door; inserting an engagement end of a hand tool into the engagement opening, the engaging end of the hand tool comprising a frontwardly-facing second engagement surface; temporarily coupling the second engagement surface of the hand tool with the first engagement surface of the engagement opening; and pulling the temporarily coupled hand tool in a direction away from the door and thereby pivoting the door about the hinges and correspondingly opening the door.

Preferably, the engagement opening is comprised in a pull base mounted to the door, and the method comprises inserting the engagement end of the hand tool into the engagement opening of the pull base and pulling the temporarily coupled hand tool in a direction away from the pull base and thereby opening the door.

The method preferably includes uncoupling and removing the hand tool from the door before the door is reclosed.

In some embodiments, the method includes moving the second engagement surface laterally into coupling relationship with the first engagement surface and subsequently pulling open the door.

In other embodiments, the method includes rotating the second engagement surface into coupling relationship with the first engagement surface and subsequently pulling open the door.

Figure 1:
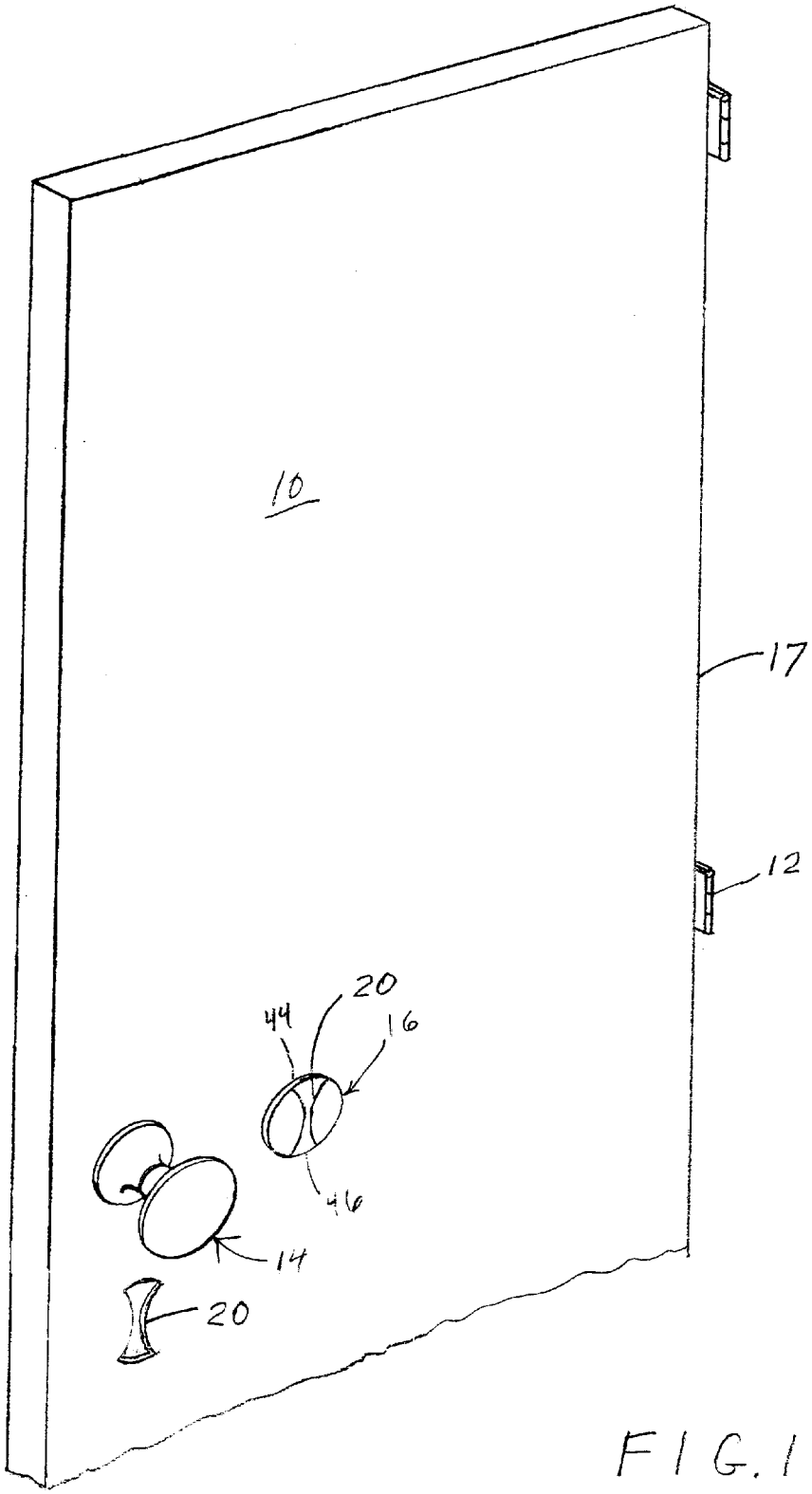
FIG. 1 is a fragmentary pictorial view of a door bearing a pull base of the invention as well as an engagement slot built directly into the door.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

FIG. 1 is a fragmentary pictorial view of a door 10 hinged at hinges 12 and having a standard opening knob 14 for pulling the door open in conventional manner. In place of knob 14, there could as well be used a conventional C-shaped, or other configuration, handle (not shown). Pull base 16 is mounted to door 10 beside knob 14 and away from the hinged edge 17 of the door.

As illustrated, the invention finds use on doors which are not routinely latched under conditions when the invention is in use. Thus, door 10 bears no indication of a latch in association with the standard knob 14. In the alternative, the door can include a latch which can be temporarily inactivated while the room is open for use, and which can be reactivated when use of the room is restricted or prohibited. Further, the door can include a self-opening latch, which releases the door from an associated door frame upon the exercise of no more than modest pull force imposed on the door.

Such door can, of course, be locked using e.g. conventional lock hardware (not shown) when the room is closed to routine use as a restroom.

Figure 2:
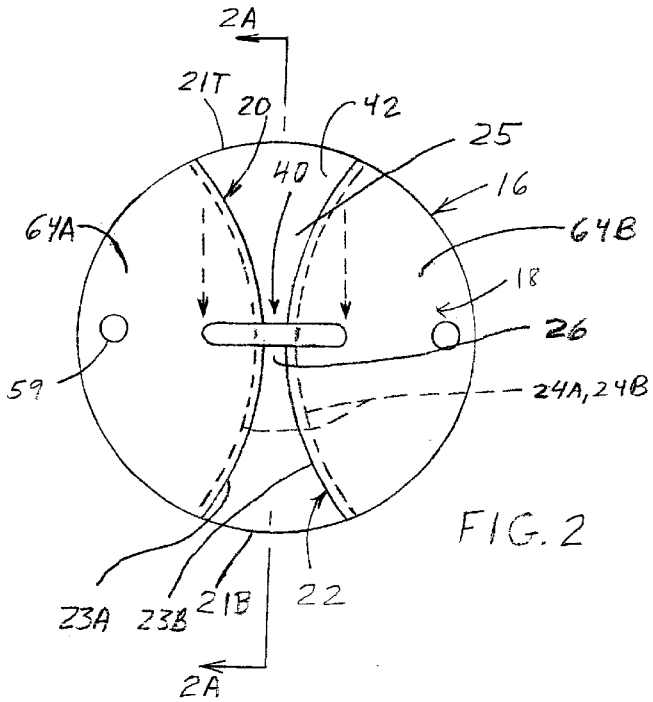
FIG. 2 shows an elevation view of the pull base of FIG. 1, with a hand tool engaged with the pull base.
Figure 3:
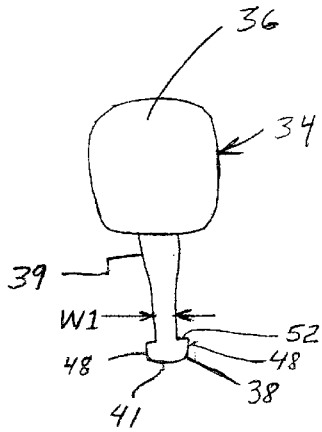
FIG. 3 is a top view of the hand tool shown engaged with the pull base in FIG. 2.

Referring now to FIGS. 2 and 3, pull base 16 includes a pull base body 18 bearing an elongate engagement slot 20 which functions in part as a first engagement element. In the embodiment illustrated in FIGS. 1–3, elongate slot 20 extends generally from the top 21T of the pull base to the bottom 21B of the pull base. The slot is relatively wider at first top and bottom segments thereof, and is relatively narrower at a central necked-in second segment 40 of the slot.

Slot 20 has a primary opening 22 having a first width defined by first and second side walls 23A, 23B. The primary opening defines the narrowest outline of the slot at any place along the path 25 traversed by the slot from the top of the pull base to the bottom of the pull base. A generally wider first engagement portion 26 of the slot cross-section lies behind primary slot opening 22, frontwardly of rear surface 28, and between third and fourth side walls 24A, 24B. The engagement portion of the slot includes a rear-facing first engagement surface 32. Thus first engagement portion 26 is disposed behind a front wall 33 of the pull base, and extends laterally from primary opening 22, transverse to path 25 as shown in especially FIGS. 2 and 4, and provides an open cavity 30 having opposing cavity portions extending generally along the full length of the path of slot 20. Cavity 30 and slot 20 function together as the first engagement element.

Figure 4:
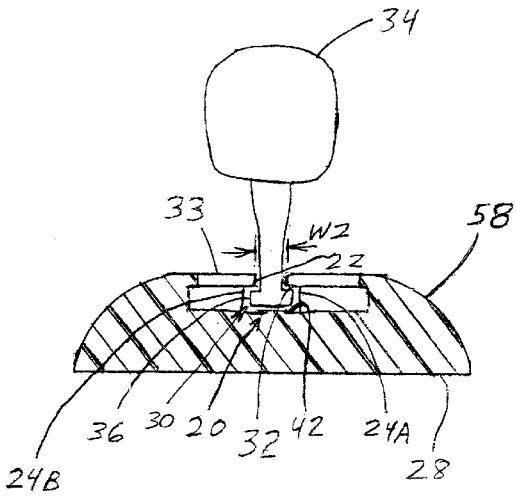
FIG. 4 shows a top view of the hand tool illustrated in FIG. 3, and illustrates the engagement of the hand tool in an engagement slot in the pull base.

Referring still to FIGS. 2, 3, and 4, a hand tool 34 has a grasping end 36, an engagement end 38, and a shaft 39 connecting the grasping end to the engagement end. The shaft has a first cross-section width "W1" adjacent the engagement end. The slot 20 has a second width "W2" at primary opening 22, greater than the first width "W1," and a third width "W3" behind front wall 33 and between walls 24A and 24B, greater than the second width. Engagement end 38 is sized and configured such that an engagement portion 41 has opposing projections which fit into opposing sides of the cavity at the engagement portion 26 of the slot, namely at the necked-in central segment 40 of the slot.

As illustrated in FIG. 2, engagement end 38 of hand tool 34 is urged downwardly along the length of slot 20 from the top 21T of pull base 16 toward bottom 21B of the pull base, in front of back surface 42 of the slot. As the engaging end of the hand tool progresses downwardly in slot 20, along the progressively narrowing slot, the distance between the lateral edges 48 of the engagement end 38 of hand tool 34, and side edges 24A, 24B of the engagement portion of the slot, decreases, as illustrated in FIG. 2.

As the hand tool is moved downwardly along the length of the slot, the engagement surfaces 52 of the engagement end 38 of the hand tool extend behind engagement surface 32 of the slot on both sides of the slot. Engagement surfaces 52 are then in position to positively engage engagement surfaces 32 of the slot. The user can at that point pull on the hand tool and thus bring engagement surfaces 52 into engagement with engagement surfaces 32, temporarily coupling the first and second engagement surfaces 32 and 52 to each other. Thus, engagement end 38 functions as a second engagement element. Pulling on the hand tool applies pull force, through the pull base, to the door, thereby to open the door.

The above described process thus opens the door without the user having to touch the door whereby any contamination which may exist on the door is not transferred to the user.

With the door thus opened, the user urges the hand tool further downwardly and out of the slot. In the alternative, the user may urge the hand tool upwardly and out of the slot. In cases where the engagement end of the hand tool between edges 48 is wider than the narrowest section of the engagement portion 26 of slot 20, interference between the engagement end of the hand tool and one or more walls in slot 20 may interfere with and/or stop the hand tool from sliding along the slot before the hand tool reaches the narrowest portion of the slot at neck 40. In such case, the hand tool is disengaged after use by moving the hand tool upwardly.

Thus, after the door has been opened, the user removes the hand tool from the door before the door is reclosed. After removing the hand tool, the user may discard the hand tool if the hand tool is intended for a single use, or may e.g. take the hand tool with him/her if the hand tool is intended for single user but multiple use application.

Figure 2A:
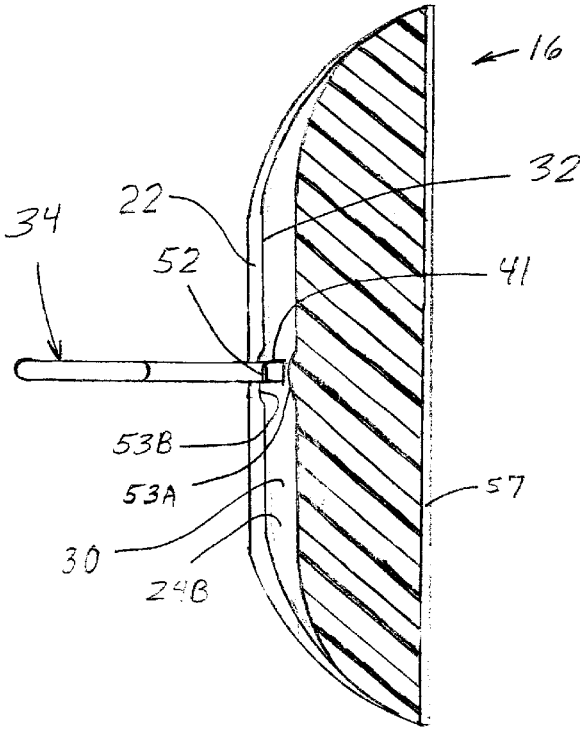
FIG. 2A shows a cross-section of the pull base of FIG. 2, taken at 2A—2A of FIG. 2.

FIG. 2A shows a cross-section of the pull base of FIG. 2, in combination with tool 34. As illustrated in FIG. 2A, back surface 42 of slot 20 preferably includes a projection 53A, e.g. a ramped projection, centrally located on the pull base. The purpose of projection 53A is to assist in positioning and holding the engagement end of the hand tool proximate the middle of the pull base so that the hand tool is generally fixed in location in the pull base while the door is being pulled open.

A corresponding recess 53B is preferably disposed at engagement surface 32 opposite projection 53A. As tool 34 is moved downwardly in the slot, the bottom of the engagement end of the tool encounters projection 53A at or proximate the location where it is desired to fix the position of the engagement end of the hand tool for opening the door. As the bottom of the tool engages the projection, upon further downward movement of the tool, the projection urges the engagement end of the tool toward and into recess 53B.

Correspondingly, the user pulls on the hand tool, bringing engagement surface 52 on the hand tool into solid and fixed-position engagement with engagement surface 32 on the pull base in the recess. So long as the user continues to pull on the hand tool, the pulling force continues to urge the engagement end of the hand tool into recess 53B, thus tending to retain the engagement end of the hand tool in the recess. Accordingly, the hand tool typically remains fixed in position, laterally by the sides of the slot, and longitudinally by the recess, so long as the user continues to pull on the hand tool, away from the door, typically as long as the user takes to pull open the door.

Figure 5:
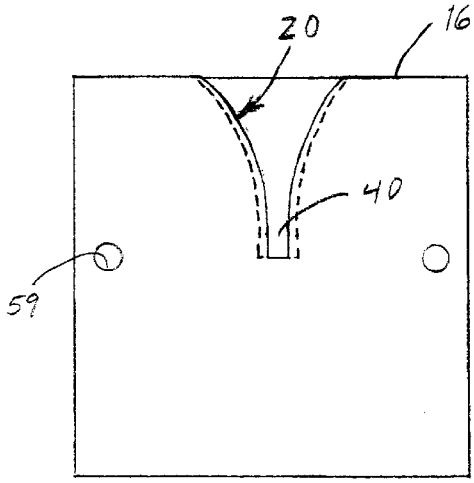
FIGS. 5–7 show additional embodiments of the pull base wherein the hand tool can be engaged with the slot in the pull base by a linear sliding movement of the hand tool with respect to the pull base.
Figure 6:
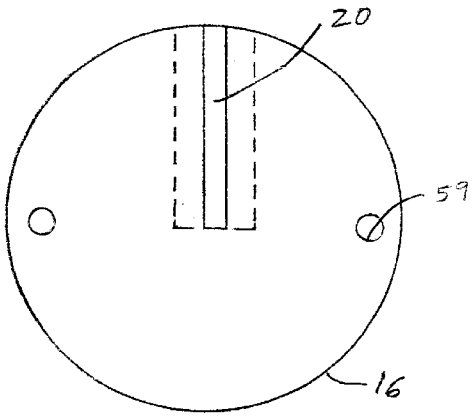
Figure 7:
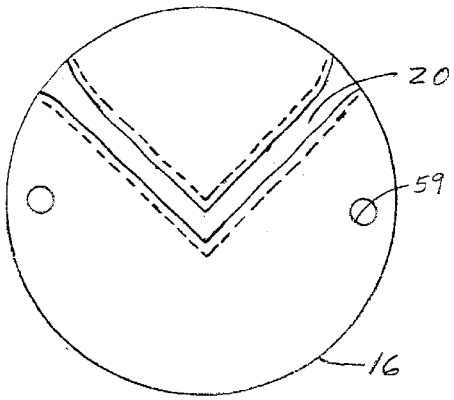

FIGS. 5–7 show additional embodiments of the pull base wherein the hand tool is engaged with the slot in the pull base by a linear sliding movement of the hand tool with respect to the pull base, as in FIGS. 2–4. Contrary to the embodiment of FIGS. 2–4, in the embodiments of FIGS. 5–7, the hand tool cannot be disengaged from the slot by continuing to move the hand tool in the direction the hand tool was moved when entering and engaging the slot.

Rather, in FIG. 5, the hand tool is disengaged by sliding the hand tool upwardly into the expanded area of the slot. In FIG. 6, the hand tool is disengaged by sliding the hand tool upwardly along a constant-width slot, or nearly constant-width slot. In FIG. 7, the hand tool can enter the slot from either the upper left or upper right of the pull base, and can exit the slot through either entry locus. Note the expanded width of the slot near the entry loci, for ease of aligning the hand tool with the respective entry locus.

Figure 8:
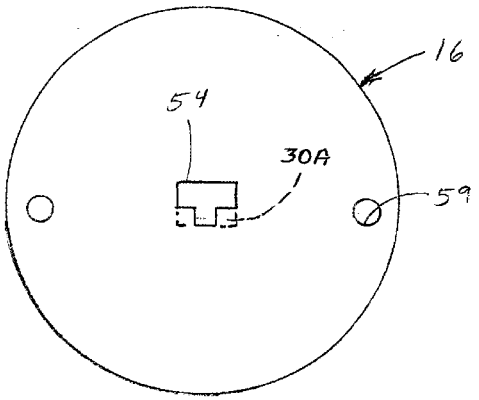
FIG. 8 shows a further embodiment of the pull base wherein the hand tool can be engaged with the pull base by inserting the hand tool through an engagement opening in the pull base into a cavity behind the opening, and then moving the engagement element of the hand tool laterally in the cavity to so engage a front-facing engagement surface of the hand tool with a rear-facing engagement surface of the pull base.

Referring to FIG. 8, an engagement opening 54 receives the engaging end 38 of hand tool 34. The door is engaged by first inserting the engagement end of the hand tool into engagement opening 54 and thence into cavity 30A defined rearwardly of T-shaped engagement opening 54. Assuming an upright orientation of the pull base as shown in FIG. 8, the engagement end of the hand tool is then urged downwardly, or in other lateral direction as appropriate, such that the engagement surfaces 52 of the hand tool move behind engagement surfaces corresponding to surfaces 32 in FIG. 4. The door can then be opened by pulling on the hand tool.

Figure 9:
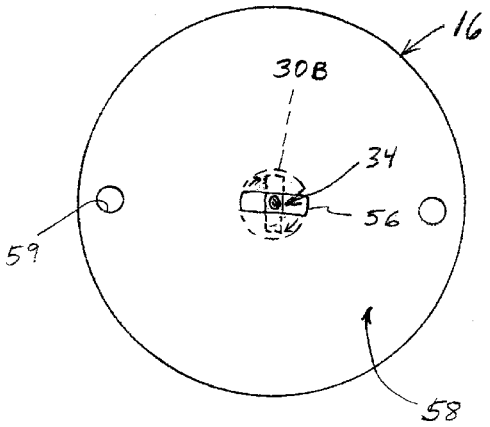
FIG. 9 shows yet another embodiment of the pull base wherein the hand tool is engaged with the pull base by inserting the engagement end of the hand tool through the engagement opening into a cavity behind the opening, and then rotating the engagement end of the hand tool in the cavity to so engage a front-facing engagement surface of the hand tool with a rear-facing engagement surface of the pull base.

FIG. 9 shows yet another embodiment of the pull base, again with an insertion-type entry of the hand tool engaging end as in FIG. 8, again in combination with a cavity 30B in the pull base. The engagement opening in FIG. 9 includes an elongate slot-type opening 56 in the front surface 58 of the pull base. Behind opening 56 is cavity 30B which extends rearwardly of, and on both sides of, opening 56. The engaging end of the hand tool can thus be inserted into the opening, and rotated so the engagement surfaces 52 of the hand tool engage corresponding engagement surfaces 32 on the pull base, whereupon the door can be pulled open by pulling on the hand tool.

Any pull base, such as those illustrated, can be oriented in any direction whereby e.g. up as illustrated herein may be down and down as illustrated herein may be up. Left or right as illustrated herein may be similarly reversed or otherwise modified.

Rather limited-size openings 54, 56 have been illustrated. Similarly rather limited-size central engagement portions 40 of the slots have been illustrated for all the embodiments of the pull base. It should be understood that the invention contemplates pull bases made with material sufficiently strong that pull base 16 can be generally confined to a thin-section structure, namely a front wall, as at 33, associated with the front surface of the pull base, with substantial void space behind the frontwardly disposed structure.

Thus, rearwardly disposed portions of the pull base, namely those portions disposed generally toward the door from the front surface, may be represented by a rather large, unoccupied cavity. For example, where the pull base is made of metal such as stainless steel, the entirety of the pull base, except for any mounting structure for mounting the pull base to the door, may be confined to the area of the front wall, along with sufficient structure to define one or more elements abutting a face of the door. For example, the rear of the pull base can be represented by structural edges which define an imaginary surface which will correspond with a surface of a door to which the pull base can be mounted.

The pull base can, of course, comprise a rear mounting surface as at 28, such that the rear of the pull base can comprises a mounting surface comprehending any fraction of the projected front surface of the pull base, from a nominal fraction to 100 percent coverage. The projected front surface of the pull base is the front surface projected onto a door to which the pull base is compatible with being mounted.

As illustrated in e.g. FIG. 1, the pull base can be mounted to the door as a secondary mount in addition to the regular door pull, for example knob 14, or other door handle. Such secondary mount is beneficial for adding the invention to doors which already bear primary pull hardware such as knob 14.

Pull base 16 can be mounted to the door by, for example and without limitation, double sided tape 57 (FIG. 2A) on rear mounting surface 28, or by fasteners such as screws or nails through corresponding mounting holes 59 in the pull base.

The embodiments illustrated have generally shown the engagement location generally centralized with respect to body 18 of the pull base. While it is preferred that the coupling take place centrally in the pull body, off-set coupling locations are also contemplated and will work equally as well so long as proper steps are taken to accommodate the corresponding offset in stresses as the pull base is used to pull the door open.

In some alternative embodiments, the engagement slot 20 or other engagement opening can be built into the primary door handle. In such instance, suitable slot or engagement opening or other touchless engagement apparatus is designed into the door handle whereby the user can either use his/her hand on the primary handle, or can use a hand tool of the invention in engagement with the touchless engagement apparatus on the door handle, thus to open the door.

In other alternative embodiments, engagement slot 20 and a corresponding cavity 30 are cut directly into a surface of the door. These embodiments are most attractive where the slot and cavity are fabricated during manufacture of the door.

In preferred embodiments, slot 20 is displaced from the conventional handle or knob 14 so that, to the extent some users grasp the door knob or other handle with their hands to open the door, the slot does not become contaminated with organisms or other contaminants carried on their hands.

A given door, in general, has either a pull base 16 mounted on the door, or a slot 20 cut directly into the face of the door, but not both. While both structures can be used on a single door, normally there is no need for both embodiments to be employed on a single door. Rather, the user will employ the pull base or the direct cut slot, whichever is more appropriate for the application contemplated.

The invention comprehends that the user may hold and retain on his or her person a hand tool 34 for repeated use with various doors at various locations. Under such use conditions, the hand tool is not necessarily sanitary, but carries only those contaminants to which the user has already been exposed. Thus, except for e.g. toxins where repeated exposure increases health risk, further handling of the hand tool does not increase the likelihood of developing harmful medical conditions from those contaminants. Accordingly, the convenience of carrying a single hand tool in some cases outweighs the presence of a given set of organisms or other contaminants on a given hand tool, and the potential for picking up additional contaminants on engagement surfaces 52 as the hand tool is used.

In the alternative, the invention contemplates a supply of single-use sanitary hand pulls. Each hand pull is packaged in sanitary packaging, and remains sanitary until picked up and used by a user. Users can carry a supply of such hand tools with them. In the alternative, a supply of such sanitary hand tools can be placed in e.g. a receptacle positioned adjacent each respective door 10. The receptacle can be e.g. designed and configured so as to dispense sanitary individual hand tools, e.g. packages of individually wrapped hand tools, in a sanitary dispensing procedure. Such sanitary hand tools may be, for example, individually packaged in plastic film pouches. A user takes a respective package from the dispenser, opens the package, removes the hand tool, uses the hand tool to open the door, and discards the hand tool in a nearby waste receptacle. In the alternative, the packaging may maintain the hand tools in sanitary condition, and present a single hand tool at a time, for individual dispensing.

Figure 4A:
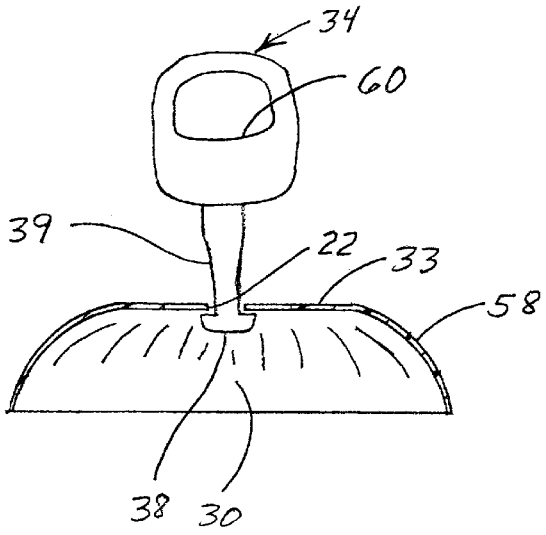
FIG. 4A shows a top view as in FIG. 4, illustrating additional embodiments of the pull base and hand tool.
Figure 3A:
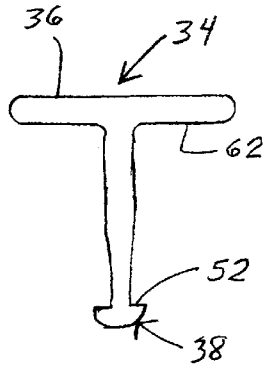
FIG. 3A shows a top view of a second embodiment of the hand tool.

Hand tool 34, as described and illustrated, somewhat resembles a conventional key. Grasping end 36 may take on a wide variety of shapes, compatible with a user grasping the grasping end when the tool is used. For example, the grasping end can have a finger opening 60 therein as illustrated in FIG. 4A, or may have e.g. opposing laterally-extending arms 62 (FIG. 3A) performing the function of grasping end 36, thus to facilitate grasping by persons having reduced gripping strength.

Correspondingly, the engaging end of the hand tool can take a wide variety of shapes and configurations, each compatible with the cross-section of the cavity 30 behind the respective slot or opening with which the hand tool is to come into engagement.

The critical feature of the invention is the use of a secondary engagement device on the door whereby a wide range of users can pull the door open without touching the door, and without the user having keys to any locking mechanism on the door. The secondary engagement device can be separate from the primary door pull or integral with the primary door pull, can be mounted on the door or integrated into the primary structure of the door, and is separate from any locking hardware on the door. Thus the secondary engagement device is inherently devoid of, and distinct from, any locking structure for locking the door.

Pull base 16 and hand tool 34 can be made from a variety of materials, including wood, plastics, metals, and the like. Especially the hand tool should be relatively inexpensive, whereby plastic materials are especially preferred.

The configuration of the engagement end of the hand tool can vary widely. A generally rectangular, box-like configuration is illustrated. For example, spherical, oblong, ovoid, and like configurations can be employed for the engagement end so long as the configuration of the engagement end of the hand tool is coordinated with the engagement surface in cavity 30 of the first engagement element on the door.

While the invention has been illustrated with a slot-type receptacle on the pull base and an intruding engagement end has been illustrated on the hand tool, the hand tool can as well be configured with the receptacle whereupon the pull base has a corresponding intruding engagement device thereon.

The embodiments have been described in terms of the engaging hand tool generally moving downwardly in an opening such as slot 20 to reach an engaging location in the opening. Upward and sideways movement can be used as well so long as the opening or slot is so oriented to accommodate such movement directions.

The first engagement element can be a separate element mounted to the door, can be incorporated as part of an otherwise conventional element of the door, or can be mounted in the door as an element of the door, or can be incorporated as part of or mounted on a door handle which can otherwise be grasped for pulling open the door.

In those embodiments where the first engagement element is mounted in the door as an element of the door, the first engagement element can be incorporated into e.g. a pull base. Material can then, for example, be removed from the body of the door to create a recessed area into which the pull base is then mounted.

The first engagement element can be fabricated in, cut into, a surface of e.g. a solid core door or e.g. a frame or panel member of a 4-panel or 6-panel door.

Especially in those embodiments wherein the first engagement element is incorporated into or mounted on the door handle, the first engagement element is preferably defined inside a recessed opening in the door handle, such that the first engagement element does not protrude from the regular door handle, and thus does not significantly interfere with routine use of the regular door handle.

As used herein a "pull handle" as applied to a door comprehends a wide range of structures which are commonly employed on doors as opening devices. There can be mentioned, for example, C-shaped loop handles, knobs such as knob 14 illustrated in FIG. 1, and all manner of other pull devices as are commonly employed for use as hand grasping devices for pulling doors open.

The engagement elements have been described herein in terms of the first engagement element representing a generally female/receptacle type configuration and the second engagement element on the hand tool representing a generally male/protruding type configuration. Such description is intended to be illustrative and not limiting. For example, the first engagement element can have a male-type configuration and the second engagement element can have a correspondingly cooperative female-type configuration. The engagement elements can have other configurations that are, for example, each part male and part female. In addition, the engagement elements can have a wide variety of other configurations so long as the engagement elements are small enough to not be effective for grasping with a person's hand, and cooperatively configured to readily engage with each other for pulling open the door.

In the alternative, and preferably, the handle/knob 14 is an auxiliary handle/knob permanently mounted to the body of the door. In either case, the hand tool and handle are cooperatively positioned so that the hand tool readily interfaces with the engagement structure in engagement slot 20 or opening 54, 56 so as to enable the user to open the door without physically touching the handle or the door, but touching only the hand tool.

The hand tool can be any structure which is relatively convenient to use, which readily interfaces with the selected slot or opening structure, and whose use is limited to only one user. The hand tool is under all contemplated uses a "single user" device although the hand tool may optionally be used repeatedly by the respective user. In environments demanding very high levels of sanitation, and very high levels of confidence in the actuality of sanitation being properly practiced, the hand tool is preferably a single use device.

The core concept of the invention is that the user can open the door without the user touching any part of the door, or any door element which has been touched by another person. In preferred embodiments, sanitation of the hand tool is assured up to the point where the user accesses the hand tool for use of such hand tool to open the door. The benefit of the invention is that the user can clean and sanitize himself/herself as desired before leaving the restroom or other cleaning facility, and can open the door to the room without risking physical contact with surfaces and/or objects contaminated by others.

The invention addresses the overall concept of the user using a hand tool that others do not use. Any portion of the hand tool contacted by a user should not be contacted by any second user whereby no second user is contaminated by a given user's use of such hand tool, nor does such second user contaminate the hand tool.

Preferably, the hand tool is sanitary when the user accesses the hand tool, and remains sanitary until the user has accomplished the opening of the door. For single use operations, once the door is successfully opened using the hand tool, the hand tool is removed from the slot or opening, and is discarded in a receptacle preferably located adjacent the door. Such used hand tools may be re-sanitized and re-packaged for re-use, as desired.

As illustrated in e.g. FIGS. 2 and 4, front 58 of the pull base comprises first and second cooperating front elements 64A, 64B which support, confine, and define slot 20 and the corresponding cavity elements. Elements 64A, 64B are shown as part of a unitary whole of pull base 16. In alternate structures (not shown), the pull base can be made of multiple elements, for example and without limitation, a rear plate (not shown) in combination with separate front elements 64A, 64B.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. Touchless door pull apparatus, comprising:

(a) a pull base for mounting on a door, said pull base comprising a first engagement element, said first engagement element being ineffective as a pull device for grasping with a hand of a user, said pull base being ineffective as a door locking device; and (b) a hand tool comprising (i) a grasping end for being grasped by such user, and (ii) an engagement end, said engagement end comprising a second engagement element, said first and second engagement elements being cooperatively configured such that the second engagement element on said hand tool can be engaged with the first engagement element on said pull base, thus to temporarily couple said hand tool and said pull base to each other, such that said hand tool can be pulled in a direction away from said pull base while said hand tool and said pull base remain temporarily coupled to each other whereby when said pull base is in secure association on a hinged door, away from an edge of such door bearing such hinges, such user can pull on said hand tool and thus pull open such door without touching such door or said pull base.

2. Touchless door pull apparatus as in claim 1, said pull base further comprising (i) a rear, (ii) a front, (iii) an engagement slot associated with the front, and (iv) a first engagement portion defined in said first engagement element, said first engagement portion being disposed between the front and the rear, and being associated with the engagement slot, facilitating coupling of said hand tool to said pull base, said hand tool further comprising a second engagement portion defined in said second engagement element.

3. Touchless door pull apparatus as in claim 2 wherein said rear of said pull base defines mounting structure which facilitates mounting said pull base to a face of such door at a location displaced substantially from such hinge mounting edge of such door.

4. Touchless door pull apparatus as in claim 2 wherein said rear of said pull base defines a mounting surface which facilitates mounting said pull base to a face of such door at a location displaced substantially from such hinge mounting edge of such door.

5. Touchless door pull apparatus as in claim 2, the front comprising first and second adjacent and cooperating front elements defining the slot therebetween, said first engagement element being associated with the slot at at least one of the first and second front elements.

6. Touchless door pull apparatus as in claim 2, said rear defining an optionally imaginary rear surface, said first engagement element having a first engagement surface thereof oriented transverse to a line which line is oriented perpendicular to such optionally imaginary surface.

7. Touchless door pull apparatus as in claim 2, said rear defining an optionally imaginary rear surface, said first engagement portion having a first engagement surface thereof oriented perpendicular to a line which line is oriented perpendicular to such optionally imaginary surface.

8. Touchless door pull apparatus as in claim 2 wherein the engagement slot extends from a top of said pull base to a bottom of said pull base.

9. Touchless door pull apparatus as in claim 2, the engagement slot at a first segment thereof being sufficiently wide to receive the second engagement portion of said hand tool behind the front of said pull base such that said second engagement element is between said first engagement element and the rear of said pull base, said engagement slot being relatively narrower at a second segment thereof so as to prevent lateral movement of said second engagement element from uncoupling said second engagement element from said first engagement element.

10. Touchless door pull apparatus as in claim 2, the first engagement portion being located in a central portion of said pull base.

11. Touchless door pull apparatus as in claim 2, the front defining a front surface of said pull base, the rear defining a rear surface of said pull base, said first engagement portion defining a first engagement surface extending transversely along a length of the slot rearwardly of the front surface and frontwardly of the rear surface.

12. Touchless door pull apparatus as in claim 9, said second engagement portion of said hand tool being sized and configured to engage the first engagement portion of the pull base at said second segment of the slot.

13. Touchless door pull apparatus as in claim 9, said hand tool further comprising a shaft having a first width, the slot defining a second width between opposing first and second frontwardly-disposed sides thereof at the first engagement element, and a third greater width between third and fourth sides thereof disposed rearwardly of the first and second sides, the combination of the first, second, third, and fourth sides defining a portion of the slot at the second segment thereof wherein the third width is greater than the first width of said hand tool, the slot portion being geometrically compatible with receiving and concurrently engaging opposing portions of said second engagement element at said engagement end of said hand tool.

14. Touchless door pull apparatus as in claim 1, said pull base further comprising (i) a rear, (ii) a front including a front surface, (iii) an engagement opening extending through the front surface, the engagement opening being sized and configured to receive said second engagement element, and (iv) a cavity disposed rearwardly of, and laterally displaced to a first side of, said engagement opening whereby said engagement end of said hand tool can be inserted into the engagement opening and laterally displaced toward engaging relationship with said first engagement element.

15. Touchless door pull apparatus as in claim 1, said pull base further comprising (i) a rear, (ii) a front including a front surface, (iii) an engagement opening extending through the front surface, the engagement opening being sized and configured to receive said second engagement element, and (iv) a cavity disposed rearwardly of, and rotationally displaced on opposing sides of, said engagement opening whereby said engagement end of said hand tool can be inserted into the engagement opening and rotated toward engaging relationship with said first engagement element.

16. Touchless door pull apparatus as in claim 2 wherein the engagement slot extends from a relatively upwardly disposed location to a relatively downwardly disposed location.

17. Touchless door pull apparatus as in claim 2, including a recess in a frontwardly-disposed wall of the slot, for receiving the engagement end of said hand tool and thereby tending to fix location of said hand tool in the slot and to so facilitate retaining the engagement end of said hand tool in the recess while the door is being pulled open.

18. Touchless door pull apparatus as in claim 17, including a projection on a rear wall of the slot, in cooperating juxtaposition to the recess, such that the projection tends to urge the engagement end of said hand tool into the recess.

19. Touchless door pull apparatus, comprising:

(a) a door having a hinged edge thereof, (i) a door pull effective as a pull device for grasping with a hand of a user and opening said door, and (ii) a first engagement element ineffective as a pull device for grasping with such hand of such user and opening said door, and ineffective as a door locking device, said first engagement element being disposed away from the hinged edge of said door; and (b) a hand tool comprising (i) a grasping end for being grasped by such user, and (ii) an engagement end comprising a second engagement element, said first and second engagement elements being cooperatively configured such that the second engagement element on said hand tool can be engaged with the first engagement element on said door, thus to temporarily couple said hand tool and said door to each other, such that said hand tool can be pulled in a direction away from said door while said hand tool and said door remain temporarily coupled to each other and such that such user can thereby pull on said hand tool and pull open such door without touching such door.

20. Touchless door pull apparatus as in claim 19, said door further comprising (i) a rear, (ii) a front, (iii) an engagement slot associated with the front, and (iv) a first engagement portion defined in said first engagement element, said first engagement portion being disposed between the front and the rear, and being associated with the engagement slot, facilitating coupling of said hand tool to said door, said hand tool further comprising a second engagement portion defining the second engagement element.

21. Touchless door pull apparatus as in claim 20, the front comprising first and second adjacent and cooperating front elements defining the slot therebetween, said first engagement element being associated with the slot at at least one of the first and second front elements.

22. Touchless door pull apparatus as in claim 20 wherein the engagement slot extends from a relatively upwardly disposed location to a relatively downwardly disposed location.

23. Touchless door pull apparatus as in claim 20, the engagement slot at a first segment thereof being sufficiently wide to receive the second engagement portion of said hand tool behind the slot such that said second engagement element is between said first engagement element and the rear of said door, said engagement slot being relatively narrower at a second segment thereof so as to prevent lateral movement of said second engagement element from uncoupling said second engagement element from said first engagement element.

24. Touchless door pull apparatus as in claim 20, the front defining a front surface of said door, the rear defining a rear surface of said door, said first engagement portion defining a first engagement surface extending transversely along a length of the slot rearwardly of the front surface and frontwardly of the rear surface.

25. Touchless door pull apparatus as in claim 23, said second engagement portion of said hand tool being sized and configured to engage the first engagement portion of the door at said second segment.

26. Touchless door pull apparatus as in claim 23, said hand tool further comprising a shaft having a first width, the slot defining a second width between opposing first and second frontwardly-disposed sides thereof at the first engagement element, and a third greater width between third and fourth sides thereof disposed rearwardly of the first and second sides, the combination of the first, second, third, and fourth sides defining a portion of the slot at the second segment thereof wherein the third width is greater than the first width of said hand tool, the slot portion being geometrically compatible with receiving and concurrently engaging opposing portions of said second engagement element at said engagement end of said hand tool.

27. Touchless door pull apparatus as in claim 19, said door further comprising (i) a rear, (ii) a front including a front surface, (iii) an engagement opening extending through the front surface, the engagement opening being sized and configured to receive said second engagement element, and (iv) a cavity behind, and laterally displaced to a first side of said engagement opening whereby said engagement end of said hand tool can be inserted into the engagement opening and laterally displaced toward engaging relationship with said first engagement element.

28. Touchless door pull apparatus as in claim 19, said door further comprising (i) a rear, (ii) a front including a front surface, (iii) an engagement opening extending through the front surface, the engagement opening being sized and configured to receive said second engagement element, and (iv) a cavity behind, and rotationally displaced on opposing sides of said engagement opening whereby said engagement end of said hand tool can be inserted into the engagement opening and rotated toward engaging relationship with said first engagement element.

29. Touchless door pull apparatus as in claim 20 wherein the engagement slot extends from a relatively upwardly disposed location to a relatively downwardly disposed location.

30. Touchless door pull apparatus as in claim 20, including a recess in a frontwardly-disposed wall of the slot, for receiving the engagement end of said hand tool and thereby tending to fix location of said hand tool in the slot and to so facilitate retaining the engagement end of said hand tool in the recess while the door is being pulled open.

31. Touchless door pull apparatus as in claim 20, including a projection on a rear wall of the slot, in cooperating juxtaposition to the recess, such that the projection tends to urge the engagement end of said hand tool into the recess.

32. A method by which a person can pull open a door having a front and a rear, and mounted on hinges, without such person touching the door, the method comprising:

(a) defining on the door an engagement opening therein, the engagement opening comprising a rearwardly-facing first engagement surface associated with the engagement opening, the engagement opening being disposed away from a hinge-bearing edge of such door, the engagement opening further being devoid of, and distinct from, locking structure for locking the door;

(b) inserting an engagement end of a hand tool into the engagement opening, the engaging end of the hand tool comprising a frontwardly-facing second engagement surface;

(c) temporarily coupling the second engagement surface of the hand tool with the first engagement surface of the engagement opening; and (d) pulling the temporarily coupled hand tool in a direction away from the door and thereby pivoting the door about the hinges and correspondingly opening the door.

33. A method as in claim 32, the engagement opening being comprised in a pull base mounted to the door, the method comprising inserting the engagement end of the hand tool into the engagement opening of the pull base and pulling the temporarily coupled hand tool in a direction away from the pull base and thereby opening the door.

34. A method as in claim 32 and including uncoupling and removing the hand tool from the door before reclosure of the door.

35. A method as in claim 33 and including uncoupling and removing the hand tool from the pull base before reclosure of the door.

36. A method as in claim 32, including moving the second engagement surface laterally into coupling relationship with the first engagement surface and subsequently pulling open the door.

37. A method as in claim 32, including rotating the second engagement surface into coupling relationship with the first engagement surface and subsequently pulling open the door.

* * * * *